United States Patent [19]

Gilgen

[11] 4,206,745

[45] Jun. 10, 1980

[54] SOLAR OPERATED CHEMICAL HEAT PUMP

[76] Inventor: James K. Gilgen, 979 Montgomery Dr., Sandy, Utah 84070

[21] Appl. No.: 925,994

[22] Filed: Jul. 19, 1978

[51] Int. Cl.[2] ..... F24J 3/02

[52] U.S. Cl. ..... 126/271.1; 62/2; 62/118; 165/DIG. 17; 261/125; 261/128; 126/417

[58] Field of Search ..... 165/1, 2, 107, DIG. 17; 261/125, 128; 126/271; 237/1 A; 62/2, 118, 478

[56] References Cited

U.S. PATENT DOCUMENTS

| | | | |
|---|---|---|---|
| 2,908,485 | 10/1959 | Longwell | 165/1 |
| 3,269,458 | 8/1966 | Rogers | 165/2 |
| 3,338,477 | 8/1967 | McKinnie et al. | 165/1 X |
| 3,973,552 | 8/1976 | Ervin, Jr. | 165/1 X |

FOREIGN PATENT DOCUMENTS

| | | | |
|---|---|---|---|
| 2346649 | 10/1977 | France | 237/1 A |

*Primary Examiner*—Leland A. Sebastian

[57] ABSTRACT

A solar operated chemical heat pump useful in both the heating and cooling modes. This system includes an insulated tank containing a fluid which is heated from the exterior. A heat sink in the form of a second tank is also employed. A water-ammonia solution is present in each tank, and conduit means are provided for respectively conducting the vapor of each tank into a bubble plate or similar structure of the remaining tank, this for effecting a thorough dispersion of incoming vapor into the liquid of the respective tanks. Heat from a solar heat source is used to heat the liquid of the first tank to drive off vapor under pressure so that the ammonia gas released can be bubbled through the water of the second tank. This process serves to gradually reduce the ammonium ions in the liquid of the first tank and enables the second tank to serve as a heat sink for the system. During night-time hours, when the vapor pressure in the first tank is reduced to a point below the vapor pressure in the second tank, then gaseous flow is reversed so as to produce an endothermic reaction in the second tank, whereby to draw heat from the sink area, and an exothermic reaction in the first tank so as to produce usable heat during night-time periods.

In effect, what is obtained is a chemical heat pump that is solar operated.

11 Claims, 1 Drawing Figure

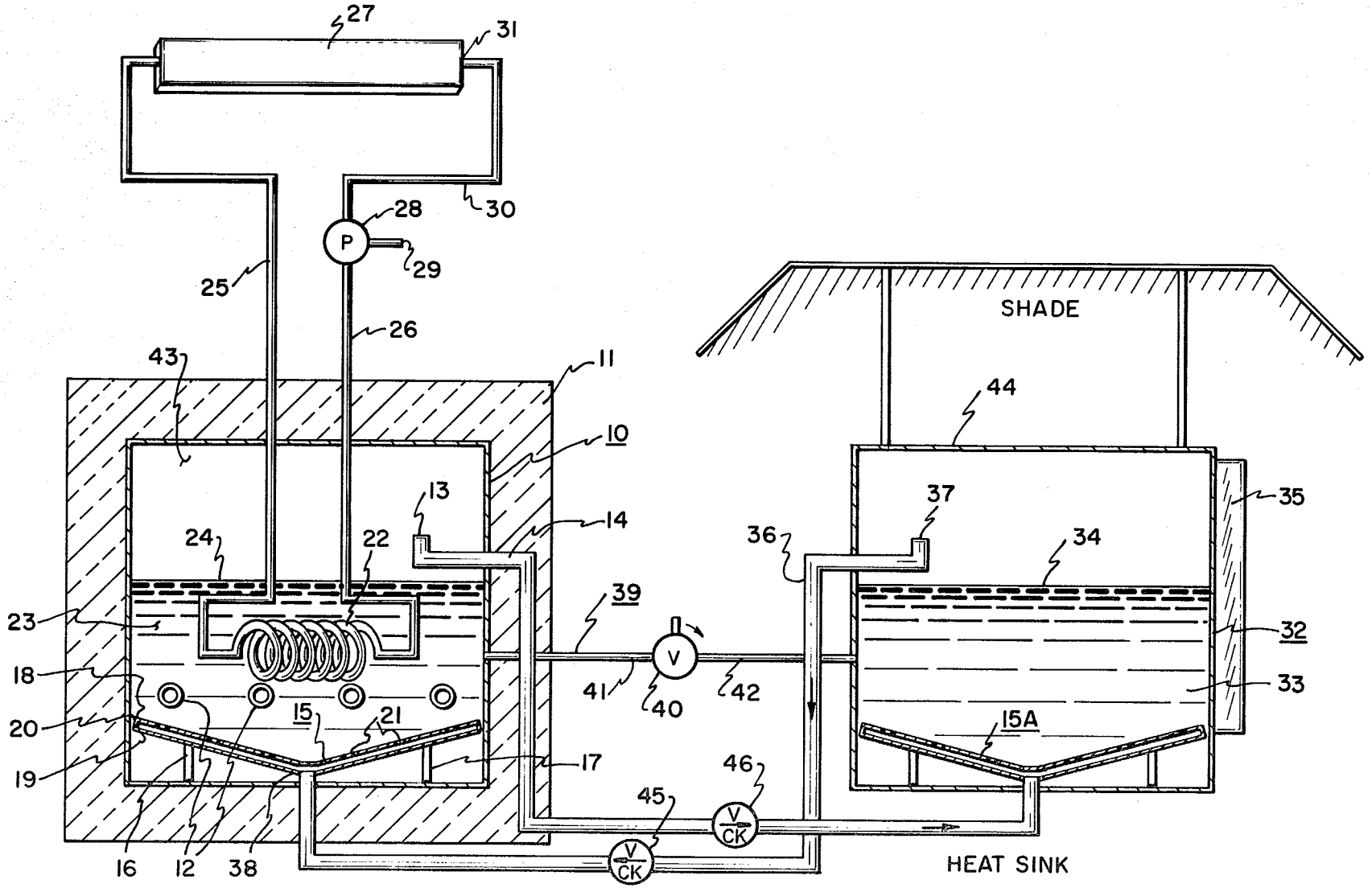
SHADE
HEAT SINK
P
V
V/CK
V/CK

SOLAR OPERATED CHEMICAL HEAT PUMP

FIELD OF INVENTION

The present invention relates to solar operated heating and cooling systems and, more particularly, to a solar operated chemical heat pump having reversible cycles and utilizing exothermic and endothermic principles.

DESCRIPTION OF PRIOR ART

In the past many types of solar operated closed systems have been developed for accomplishing heating purposes. Certain patents are known and are cited herein as follows:

U.S. Pat. No. 3,893,506
U.S. Pat. No. 3,903,699
U.S. Pat. No. 3,923,038
U.S. Pat. No. 3,952,519
U.S. Pat. No. 4,037,579
U.S. Pat. No. 4,038,966
U.S. Pat. No. 4,059,093
U.S. Pat. No. 4,061,131

The concept of the present invention, in contrast with the above art, is the utilization of two fluids, namely water and ammonia in a closed system utilizing separated storage tanks, wherein by reversible cycles an area may be heated or cooled in accordance with general heat pump principles. In contrast with other arts, the heat pump of the present invention is actually a chemically operated heat pump, with the initial energy being periodically derived by solar responsive means.

BRIEF DESCRIPTION OF THE INVENTION

In the present invention a closed system is utilized, the same being provided with an insulated tank and also a second tank, the latter of which serves as a heat sink. Conduit means are provided for conducting vapor flow from the first tank to the liquid phase in the second tank and, correspondingly, from the second tank into the liquid phase of the first tank. Bubble plates or bubble caps are used to facilitate a thorough dispersion of incoming gases into the water of the respective tanks. Means are likewise supplied for leveling fluid levels at the beginning of each cycle.

External heat as from a solar heat source, for example, is utilized to heat the fluid in the first tank so as to cause a release of ammonia gas into the vapor state above the water in such first tank, and this at a vapor pressure sufficient for the gas to be conducted into the liquid phase of the second tank. The gas disburses through the liquid in the second tank and sensible heat is removed at such heat sink, namely the second tank through one of a variety of means. The solar energy used, however, relative to the insulated first tank, reduces the concentration of ammonium ions and otherwise prepares the first tank for exothermic reaction during the night time period. At such period heat is drawn from the surroundings as gas in the second tank escapes from the liquid phase and is conducted through the liquid phase of the first tank. In so doing, there is a combination of ammonia and water in the first tank into ammonium hydroxide, which liberates heat. It is this latter heat that is utilized in the dwelling or other area where heat is desired during the night time hours.

OBJECTS

Accordingly, a principal object of the present invention is to provide a new type of closed system for heating and/or cooling purposes.

A further object is to provide a chemically operated heat pump.

A further object is to provide a solar energy activated chemical heat pump.

A further object is to provide a heat sink or heat receptor in a closed system and, in combination therewith, an insulated tank, the latter being operated by an external heat source.

A further object is to provide an ammonia-water closed system for producing heat and cooling effects.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

The sole FIGURE is a diagram on the ammonia-water closed system of the present invention in one form thereof.

DESCRIPTION OF PREFERRED EMBODIMENTS

In FIG. 1 container 10 is enclosed within insulation 11 and includes, passing there-through, a series of heat exchange pipes 12. The open end 13 of conduit 14 is positioned as indicated for the reception of the gas or vapor phase. At the bottom of tank 10 is disposed a bubble plate 15 which is preferably slightly dish-shaped and concave upwardly. The same includes supports 16 and 17. Such plate may include a pair of spaced back-to-back walls 18 and 19 which are sealed together at their periphery 20. The wall 18 is provided with a series of perforations 21.

Conduit coil 22 is disposed within liquid 23, the same exhibiting fluid level 24. Coil 22 is coupled by conduit 25 and 26 to a solar collection plate 27 and to pump 28. Pump 28 includes an actuation switch 29 and a conduit 30 connecting the pump to the opposite end 31 of the solar collection plate.

The heat sink of the system includes a tank 32 having therein liquid 33 providing fluid level 34. The tank may preferably include a series of cooling fins 35, with such tank being kept in a cooled area such as at the shady side of a home or other building. Conduit 36 includes its open end 37 within the vapor section of the tank or container, such conduit 36 being connected to the base 38 of bubble plate 15. A corresponding bubble plate 15A is seen at the base of tank 32 and will be similarly constructed to bubble plate 15 shown within tank 10. Conduit 39 includes a medial, manually operable valve 40, opposite lengths of the general conduit at 41 and 42 being coupled to the individual tanks 10 and 32.

The system herein contemplates the use of ordinary water plus ammonia. Ammonia ($NH_3$) is a gas at ambient temperatures, and comprises polar molecules which are pyramdal in shape. Ammonia is easily condensed at minus 33° centigrade to a liquid of great solvent power. Ammonia gas is very soluable in water and forms with water a weak base, namely ammonium hydroxide. Recent nuclear magnetic experiments indicate that electrons jump back and forth rapidly between nitrogen and oxygen atoms so that the conventional distinction between $NH_3$ plus $H_2O$ and $NH_4OH$ is somewhat arbitrary. In any event, when ammonia gas is absorbed by water the sensible heat of the gas at elevated temperatures of course heats the water. Additionally, there is an exothermal effect whereby the gas entering the water and forming the hydroxide ion will give off heat, to further raise the temperature of the water.

As to the specific structure shown in the sole FIGURE, the fluid at 23 in tank 10 comprises a water-ammonia solution. The fluid at 33 in tank 32 is likewise a water-ammonia solution. Solar collector 27 may be any one of several forms such as a conventional flat plate collector having serpentine tubing under glass which becomes heated by the sun's rays.

The operation of the system is as follows. Pump 28 is turned on during daylight hours by switch 29 so that there is a circulation of liquid, such as a water, glycol solution in conduit 25, 26 and 30, thus slowly circulating the fluid through the collector 27 so that heated fluid comes down through the coil 22 and heats the fluid at 43. If desired, during such time that the fluid at 43 is sufficiently hot, air or other media may be conducted through the series of tubes 12 to heat the interior of a building, for example.

In any event, as the temperature of the fluid at 23 progressively increases, ammonia gas plus a progressively increasing amount of water vapor is driven off, which increases the vapor pressure at 43 within tank 10. The vapor at 43 will be approximately 80% ammonia (20% water vapor) at 160° F. In any event, since tank 32 is maintained at a cooler temperature in the shade, the vapor pressure at 44 will be less than the vapor pressure at 43. The point will be reached, therefore, that the gas or vapor phase within tank 10 will enter the opening 13 of conduit 14 so as to be forced in bubble plate 15A, whereupon the gas and its accompanying water vapor are absorbed by the solution at 33 in tank 32. The purpose for the inclusion of a dish-shaped bubble plate is to insure that the vapors are conducted so that small bubbles will rise in relatively uniform disbursement through the liquid at 33, thereby facilitating ammonia gas absorption by the water.

Thus, progressively less ammonium ions are present in liquid 23 and, since water-ammonia absorption and release processes are reversible, some amount of heat will be lost chemically, owing to the evaporation of the ammonia from the water at 23. This loss is quickly made up, however, by virtue of the heat exchange contributed by solar panel 23 relative to tank 10. If we assume that the temperature in tank 10 gradually rises from an initial temperature of 60° F. to about 200° F., the vapor pressure in tank 10 would increase to about 20 pounds per square inch from the initial condition of 4 pounds per square inch.

It is noted that tank 32 is not insulated; furthermore, the same may be provided with cooling fins 35, be disposed in the shade or underground, and otherwise be subjected to conditions suitable for the heat sink which tank 32 comprises.

In any event, the heat from solar collection plate 27 is employed to compensate for lost heat, owing to the endothermic reaction of evaporation of ammonia and gradual reduction of the ammonium ions within liquid 23. In essence then, the solar heat is utilized on the reverse cycle of the chemical heat pump shown, this to disassociate essentially the ammonia theretofore present in the water at 23. And this condition will persist in a one-way flow through the daylight hours, the ammonia gradually being drawn under the pressure differential existing from tank 10 to tank 32.

When night-time arrives the pump 28 is turned off, by virtue of switch 29, so that there is no fluid flow of the water-glycol solution through conduit 25, 26 and 30 and, of course, during the day up until nightfall the heat from the ammonia gas has been dissipated by cooling fins, by the nature of the shady area in which the heat sink is mounted, and so forth. However, most of the ammonia will be dissolved in the water at 33 in tank 32.

Now the temperature in tank 10 progressively falls from 200° F. and, during such temperature reduction, the pressure within tank 10 at 43 also drops; since the point will be reached at which there will be a lesser pressure within tank 10 at 43 than the pressure at 44, owing to the predominance of ammonia in tank 32, the reverse gas or vapor flow begins to take place. This is to say, at a lower temperature now the vapor pressure at 44 in tank 32 is sufficient to cause a flow of the ammonia gas in its vapor state through opening 37 of conduit 36, and through conduit 36 to bubble plate 15 at which point the ammonia gas bubbles upwardly into the liquid at 23 so as to be absorbed and create a progressively increasing preponderance of ammonium ions. It is this chemical action that produces exothermal heat to heat the liquid at 23 and thereby allow, through a heat exchange relationship, air or another heat exchange medium to be drawn through the tubes 12 to heat the dwelling during night-time occupancy or use. This action reverses the chemical process so that the exothermal heat produced serves to heat the home during the night even though the system is operating at a lower temperature.

What in effect is obtained is the feature of a heat pump but without moving parts other than perhaps the pump 28 and even pump 28 can be eliminated where a thermosiphon principle is employed as is commonly known in the art.

Accordingly, what is effected is an exhaust of heat at heat sink tank 32, this in the process of driving off the ammonia vapor so as to reverse the chemical process as hereinbefore mentioned and, subsequently, during night-time hours, creating a gas flow owing to the pressure differential between opening 37 and 13 so as to cause an exhaust of ammonia vapor at relatively higher pressure at the heat sink tank 32; such ammonia vapor rises through the liquid at 23, is absorbed thereby, and produces exothermal heat that can be used by heat exchange at the tubes or conduit 12.

If desired, the conduit and valve at 40-42 can be employed in the general circuit 39 so as to adjust or otherwise regulate volumes in the two tanks at cycle or half-cycle points, to compensate for water-vapor migration and resultant condensation.

During night-time hours, the evaporation of the ammonia at low temperatures, owing to the increased pressure increment at 37, will produce a progressive reduction in the ammonium ions within the heat sink liquid at 32 and, thereby, actually draw heat from the surroundings relative to tank 32.

Accordingly, from the phenomena immediately above described, it will be noted that the heat sink tank 32 can actually be used as a refrigeration or cooling unit for a home, and a blower used to blow across the cooling fins or other structure 35 of tank 32 to cool passing air or other means or structure.

Thus, what is provided is exothermic and endothermic phenomena for accomplishing both heating and cooling, the outside incremental heat necessary being supplied by a solar panel 27 or by other means. High efficiencies are possible as in the case of conventional heat pumps, and more so since in a preferred form of the invention the solar panel itself supplies the incremental heat required to operate the system.

Check valves 45 and 46 are installed to prevent reverse liquid flow and thus allow only vapor flow in the directions shown.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A chemical heat pump system including, in combination: a first, insulated tank containing a water-ammonia solution; a second tank containing a water-ammonia solution; first conduit means coupled between said tanks for conducting the vapor phase in said first tank into the solution of said second tank; second conduit means for conducting the vapor phase in said second tank into the solution of said first tank; external means coupled to said first tank for heating said solution therein; heat-extraction means proximate said first tank and in heat-exchange relationship therewith for withdrawing sensible heat therefrom; and compensating means for adjusting water level in said tanks.

2. The system of claim 1 wherein said second tank comprises a heat sink.

3. The system of claim 1 wherein said external means comprises a solar heat sub-system.

4. The system of claim 1 wherein each of said conduit means include one-way check valves for checking against otherwise possible fluid return.

5. The system of claim 1 wherein said compensating means comprises a conduit interconnecting said tanks beneath their fluid levels and valve means for controlling flow through said conduit.

6. The system of claim 1 wherein each of said tanks includes a bubble plate, said first and second conduit means being coupled to a respective one of said bubble plates.

7. The system of claim 1 wherein said heat-extraction means comprise secondary fluid-flow utility conduit.

8. The system of claim 1 wherein said second tank includes cooling fins.

9. The system of claim 1 wherein said solar sub-system is selectively interruptable.

10. In combination, a pair of tanks each containing a gas-liquid solution exothermic upon gas increase and endothermic upon gas reduction relative to said solution; a pair of respective conduit means for conducting gasses from an upper portion of a respective one of said tanks to a lower portion of the remaining tank; means for applying heat to one of said tanks; means for withdrawing heat from the remaining tank and means for maintaining the operating temperature of said one tanks higher than the temperature of the remaining tank.

11. In combination, a liquid-containing tank having a bottom, a concave-upward perforate bubble plate disposed in said tank beneath its fluid level and being essentially co-extensive in size with said bottom, said bubble plate having upper and lower walls mutually secured at their peripheries and mutually defining a hollow interior, said upper wall being perforate.

* * * * *